United States Patent [19]

Wetzler

[11] 4,174,547

[45] Nov. 20, 1979

[54] HOSPITAL BED STRUCTURE

[76] Inventor: Justin J. Wetzler, 703 Sheridan Rd., Evanston, Ill. 60202

[21] Appl. No.: 876,017

[22] Filed: Feb. 8, 1978

[51] Int. Cl.[2] ..... A47C 3/32; A47C 7/10

[52] U.S. Cl. ..... 5/68; 5/63

[58] Field of Search ..... 5/63, 66–68, 5/74, 90, 91

[56] References Cited

U.S. PATENT DOCUMENTS

| | | | |
|---|---|---|---|
| 3,036,314 | 5/1962 | Wetzler | 5/63 |
| 3,059,248 | 10/1967 | Wetzler | 5/63 |
| 3,278,952 | 10/1966 | Holm | 5/66 |
| 3,332,090 | 7/1967 | Wetzler | 5/90 |
| 3,668,720 | 6/1972 | Wetzler | 5/91 |
| 3,676,881 | 7/1972 | Duprey | 5/66 |
| 3,840,911 | 10/1974 | Benoit et al. | 5/66 |

*Primary Examiner*—Casmir A. Nunberg

*Attorney, Agent, or Firm*—Hill, Van Santen, Steadman, Chiara & Simpson

[57] ABSTRACT

A hospital bed structure, in particular a power elevating and lowering arrangement which is relatively simple in construction and at the same time provides substantially instant Trendelenburg position in the event of emergency, particularly when the bed is in an elevated position, such structure including means for permitting the head end of the bed to automatically lower to the desired Trendelenburg position. The operation may be controlled by relatively simple, fool-proof manual controls that are arranged for ready access and actuation in the event of an emergency. The invention also utilizes a novel U-shaped lower bed structure which readily accommodates the operating linkage and at the same time permits, for example, the use of bed pans, movable toilets and the like.

21 Claims, 8 Drawing Figures

Fig-1
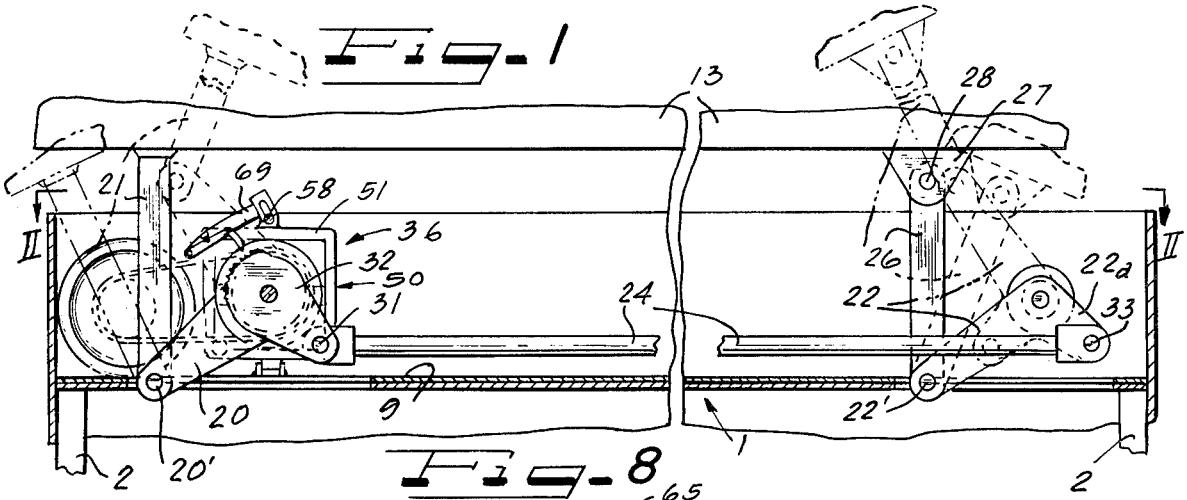
Fig-8
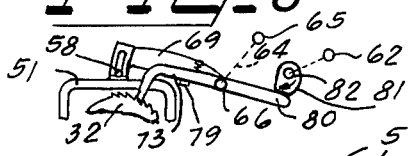
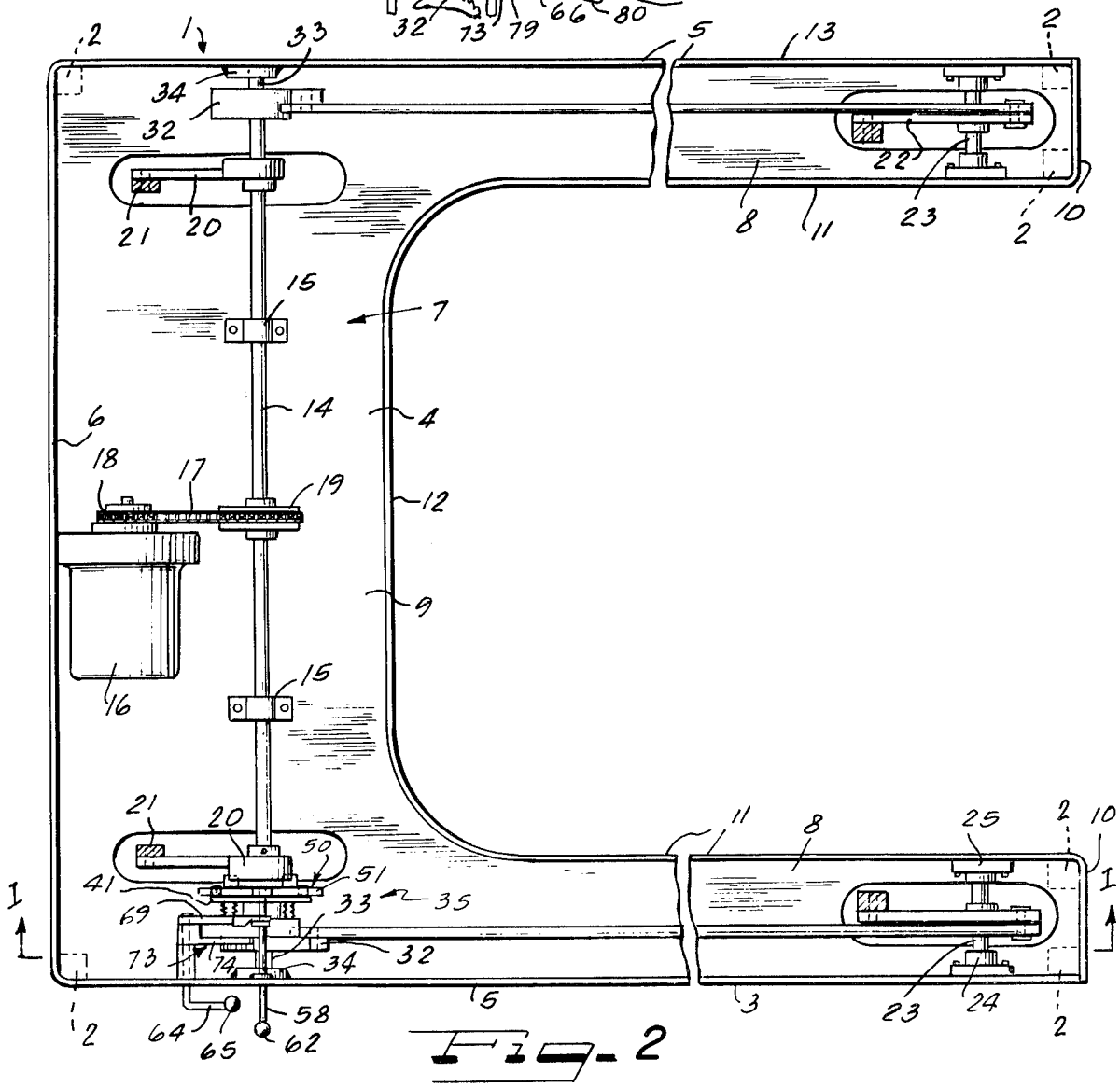
Fig-2

HOSPITAL BED STRUCTURE

BACKGROUND OF THE INVENTION

The present invention relates to hospital beds having power means for elevating or lowering the bed structure as well as enabling the elevation or lowering of merely one end of the bed to provide Trendelenburg and reverse Trendelenburg positions.

The present invention is an improvement over beds such as those illustrated in my prior U.S. Pat. No. 3,036,314 and U.S. Pat. No. 3,059,248 and at the same time is adapted to utilize optional features such as those illustrated in my prior U.S. Pat. No. 3,332,090 and U.S. Pat. No. 3,668,720.

Where linkages of the type illustrated in my prior patents are employed, the problem arises with respect to manipulation of the bed into inclined positions, particularly the Trendelenburg position in which the head end of the bed is positioned below the foot end. This position is normally employed under emergency conditions and consequently time is of particular importance in getting the patient into such position. Consequently, the bed structure should be such that it can be immediately actuated to such a position irrespective of the initial position of the bed, i.e. in elevated, lowered or intermediate positions. In beds of the type illustrated in the above referred to patents, it was necessary to bring the bed into the lowest position in order to release the structure for activation to the Trendelenburg position.

BRIEF SUMMARY OF THE INVENTION

The present invention is directed merely to the base elevating or lowering structure as distinguished from the mattress supporting structure and arrangements for placing the same to and from horizontal and sitting positions, etc.

The present invention employs a floor supported base structure which is of U-shaped configuration, in plan view, having a pair of spaced parallel side portions which are connected adjacent the foot end of the bed by a transversely extending connecting portion which carries the power means and respective drive structures at each side of the bed. The arrangement is such that the linkage to the head end of the bed may be operatively disconnected from the power means whereby the head end may be placed in a relatively lower position than the foot end irrespective of the starting position from which such an adjustment is made. Thus, if the structure is in "down" position following disconnection, the foot end may be readily and quickly elevated, while retaining the head in its lower position. If the structure is in an elevated position, the linkage for the head end may be readily disconnected from the power means and permitted to move into its lower position. Suitable means may be provided to limit the rate of downward movement of such head end under such condition. In the embodiment illustrated, friction means is provided for controlling downward movement of the head end from an elevated position and additional means provided for controlling elevation of the foot end from a lowered position.

BRIEF DESCRIPTION OF THE DRAWINGS

In the drawings wherein like reference characters indicate like or corresponding parts:

FIG. 1 is a side elevational view of a portion of the elevating and lowering mechanism, illustrating in broken lines the Trendelenburg and reverse Trendelenburg positions of head and foot ends of the patient supporting portion thereof;

FIG. 2 is a plan view of the elevating mechanism illustrated in FIG. 1;

FIG. 8 is a schematic fragmentary view of a modified control structure.

DETAILED DESCRIPTION OF THE INVENTION

General

Figure 3:
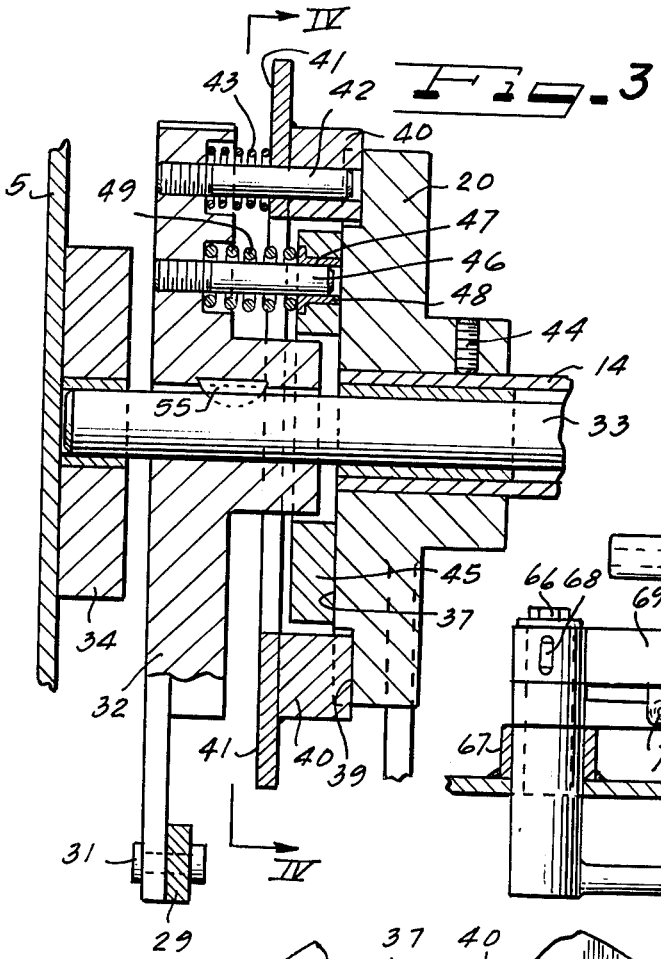
FIG. 3 is an axial sectional view of a clutch and restraining mechanism which may be employed in accordance with the invention.

Referring to the drawings and more particularly to FIGS. 1 and 2 in which only those portions of power-operated bed necessary to the understanding of the invention are illustrated, the reference numeral 1 indicates generally a relatively stationary frame or base structure adapted to be supported by a floor surface or the like through suitable leg members 2, only portions of which are illustrated and which normally would be provided with suitable caster wheels or the like. As illustrated in FIG. 2, the frame structure 1 is of generally U-shape configuration in plan, having spaced parallel longitudinally extending side portions 3 connected adjacent the head end of the bed by a transversely extending intermediate portion 4. The structure may be of any suitable structural design, that illustrated comprising relatively heavy longitudinally extending side members 5 and similar foot member 6, rigidly secured together as for example by welding and supporting a bottom wall, indicated generally by the numeral 7 and comprising leg portions 8 and an intermediate portion 9 is secured at its outer peripheral edges to the members 5 and 6, respectively. The head ends and inner edges of the portions 8 as well as the inner edge of the intermediate portion 9 of the member 7 are provided with upstanding wall members 10, 11 and 12, respectively, which are likewise secured in rigid relationship, as for example by welding.

Supported from the frame structure 1 is a mattress supporting frame 13 which, may be of rectangular configuration similar to that illustrated in the patents previously referred to, and which in turn may support an adjustable mattress supporting frame whereby the head and foot sections of the mattress may be raised or lowered relative to the frame 13.

The Elevating Structure

The structure for elevating the frame member 13 relative to the frame structure 1 comprises a hollow shaft or tube 14, journalled in suitable standards 15 mounted on the portion 9 of the member 7, which is adapted to be rotated by a suitable power source such as a motor 16 and chain 17 which connects the drive sprocket 18 with a driven sprocket 19 on the hollow shaft 14. Disposed adjacent each end of the shaft 14 and rigidly secured thereto are respective bell arms 20 which are pivotally connected adjacent their free ends to respective generally vertically extending links 21 which have their upper ends rigidly secured to the frame 13. Thus, by rotation of the shaft 14 the arms 20 may be correspondingly pivoted, clockwise rotation of the shaft, as viewed in FIG. 1 pivoting the arms 20 in a direction to elevate the associates link 21 and thus the adjacent end of the frame 13.

The head end of the frame 13 is adapted to be supported for vertical upward and downward movement by a similar pair of levers 22 which may be rigidly connected to corresponding shafts 23 having their respective free ends journalled in bearing blocks 24 and 25, respectively mounted on the walls 5 and 11, with the axis of the shafts 23 being aligned and extending in parallel relation with respect to the axis of the shaft 14. Each lever arm 22 is connected to the frame 13 by a link 26, the lower end of which is pivoted to the free end of the arm 22 as indicated at 22' with the upper end pivotally secured to a bracket 27 rigidly carried by the frame member 13, as indicated at 28.

The lever 22 is adapted to be selectively connected to the lever 20 by means of an elongated connected rod 29 having one end pivotally connected to the arm **22*a* of the lever 22 as indicated at 30. With the opposite end of the rod 29 being pivotally connected at 31 to an arm 32 carried by a shaft 33 which extends through the hollow shaft 14 and is journalled at its respective ends in bearing members 34 carried by the walls 5**.

The levers 32 are adapted to be selectively rigidly connected to the arms 20 by suitable clutch means indicated generally by the reference numeral 35, hereinafter described in detail. It will be noted that the effective length of the lever 20 is the same as that of the lever 22 and in like manner the effective length of the lever 32 has the same effective length as that of the lever **22*a*** and corresponding levers extend in parallel relation.

Thus, assuming that the levers 20 and 32 are rigidly locked together in the positions illustrated in FIG. 1, rotation of the shaft 14 in clockwise direction as viewed in FIG. 1 will result in a clockwise movement of the arms 20–32 which movement is transmitted in a corresponding manner to the levers **22*a* and 22 to elevate the frame member 13 relative to the frame structure 1**.

In like manner, rotation of the arms in a counterclockwise direction from the elevated position will result in a lowering of the frame member 13 relative to the frame structure 1.

General Operation

Assuming that the structure is in its raised position, i.e. arms 20, 22 rotated into their extreme clockwise positions as illustrated in broken lines in FIG. 1, the frame member 13 would extend in a horizontal position parallel to that illustrated which position would be retained as long as the arm 32 is rigidly held with respect to the arm 20. If the clutch 35 is engaged at this time, the arm 32 will be free to pivot to permit the arm 22 to rotate counterclockwise and lower the head end to the position illustrated in dotted lines in FIG. 1. To prevent an abrupt downward movement additional means may be provided to retard such movement, permitting the head end to move downwardly slowly and smoothly. This may be accomplished by the use of a suitable dampening mechanism as for example a hydraulic or pneumatic dampening cylinder or by suitable frictional means as hereinafter described in detail.

Similarly, if the frame 13 is a lowered condition, the Trendelenburg position may be readily achieved by disconnecting the clutch 35 and then actuating the motor 16 to elevate the foot end, again bringing the frame 13 into the Trendelenburg position.

Reversed Trendelenburg position, i.e. with the foot end of the frame member lowered below the head end, may be achieved by restricting the downward movement of the head end. This can be readily accomplished by providing a suitable latching structure indicated generally by the numeral 36,, as hereafter described, which may be selectively actuated to prevent movement of the rod in a direction permitting downward motion of the head end. Thus, if the frame 13 is in its elevated position the reverse Trendelenburg position may be suitably achieved by actuating the latching structure 36, disengaging the clutch 35 and actuating the motor 16 to lower the foot end of the bed, whereby the latter may assume positions generally corresponding to those illustrated in broken lines in FIG. 1. If the frame member 13 is in its lowered position, it would, in this case then be necessary to initially elevate the frame member to raise the head end, and then proceed as described.

Clutch Details

Figure 4:
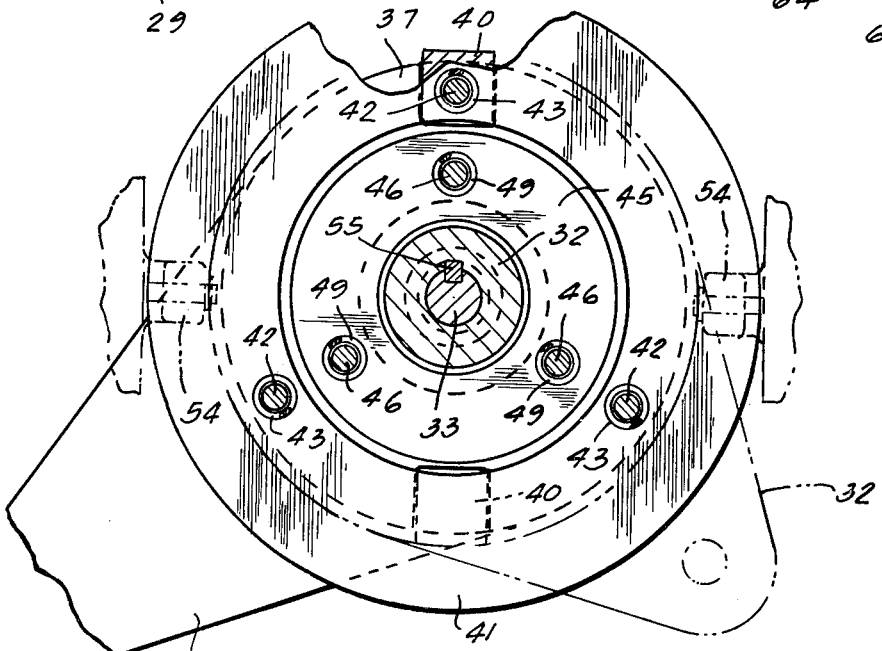
FIG. 4 is an elevational view of the structure illustrated in FIG. 3 as viewed from the right in such figure.

FIGS. 3 and 4 illustrate details of an exemplary design of the clutch 35, also incorporating friction means for damping downward movement of the head end of the structure in adjusting to the Tendelenburg position, proceeding from an initially elevated position of the frame 13.

Referring particularly to FIGS. 3 and 4, the arm 20 is provided with a flat face 37 having a plurality of notches 38 therein adapted to mate with lugs 39 carried by a clutch plate 40 carried by the arm 32 on a plurality of stud pins 41 threaded into the arm 32, three such pins being employed as illustrated in FIG. 4. The clutch member 40 is urged into engagement with the base of the arm 20 by respective compression springs 42 in circling the associated rods. Thus, the lugs 39 will normally be engaged in the slots 38 to rigidly couple the arms 20 and 32 to one another but by suitable movement of the clutch plate 40, in opposition to the action of the springs 42, the lugs 39 may be moved out of engagement with the notches 38 to disconnect the linkage, including the arms 32, from the power source 16.

As illustrated in FIG. 3, the arm 20 may be suitably secured to the hollow shaft 14, as for example by one or more set screws 43 while the arm 32 may be locked to the shaft 33 by suitable means as for example a key 44.

Bearing upon the face 37 of the arm 20 is a brake block 45, of annular configuration which is supported on three stud pins 46 threaded at one end into and supported by the arm 32, with the free ends of the pins 46 supporting the brake ring 45, preferably through suitable bushings 48. In the embodiment illustrated, three such pins are employed, each of which has a spring 49 encircling the same adapted to exert pressure on the brake ring 45 in a direction to urge the latter towards the face 37 of the arm 20. The springs 49 are so calibrated that in the event the mattress supporting member 13 is in its elevated position, upon release of the clutch 35 the head end of the frame 13 will move to its lower position under the action of gravity, with the ring 45 providing a sufficient braking action to effect relatively smooth, even action which will eliminate any tendency of such end to sharply drop from its elevated position to its lowered position. It will be appreciated that by suitable means, as for example, means adjusting the ends of the springs 49, adjacent the arm 32, the amount of compression of such springs could readily be varied to accommodate different bed loads.

The Control Mechanism

Figure 7:
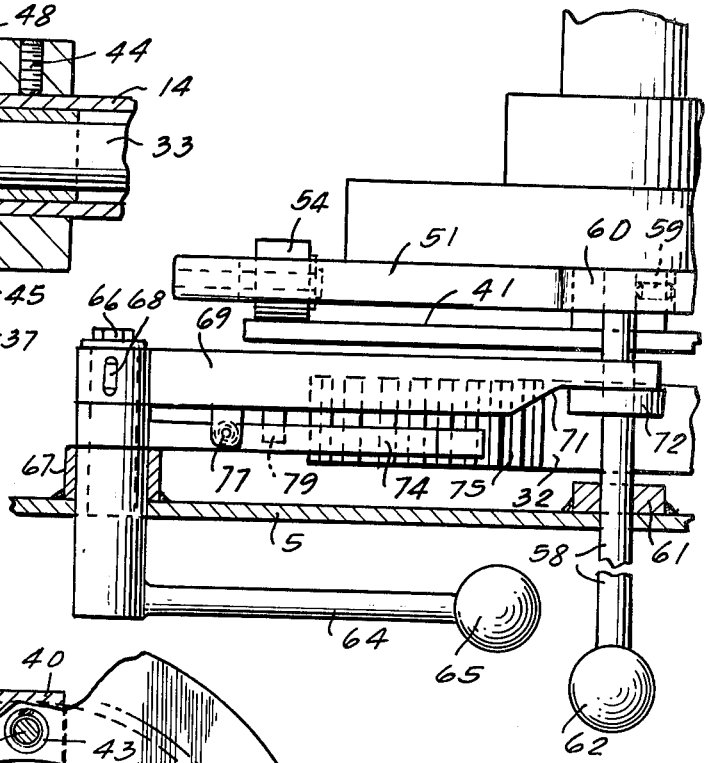
FIG. 7 is a sectional view taken approximately on the line VII—VII of FIG. 1.
Figure 6:
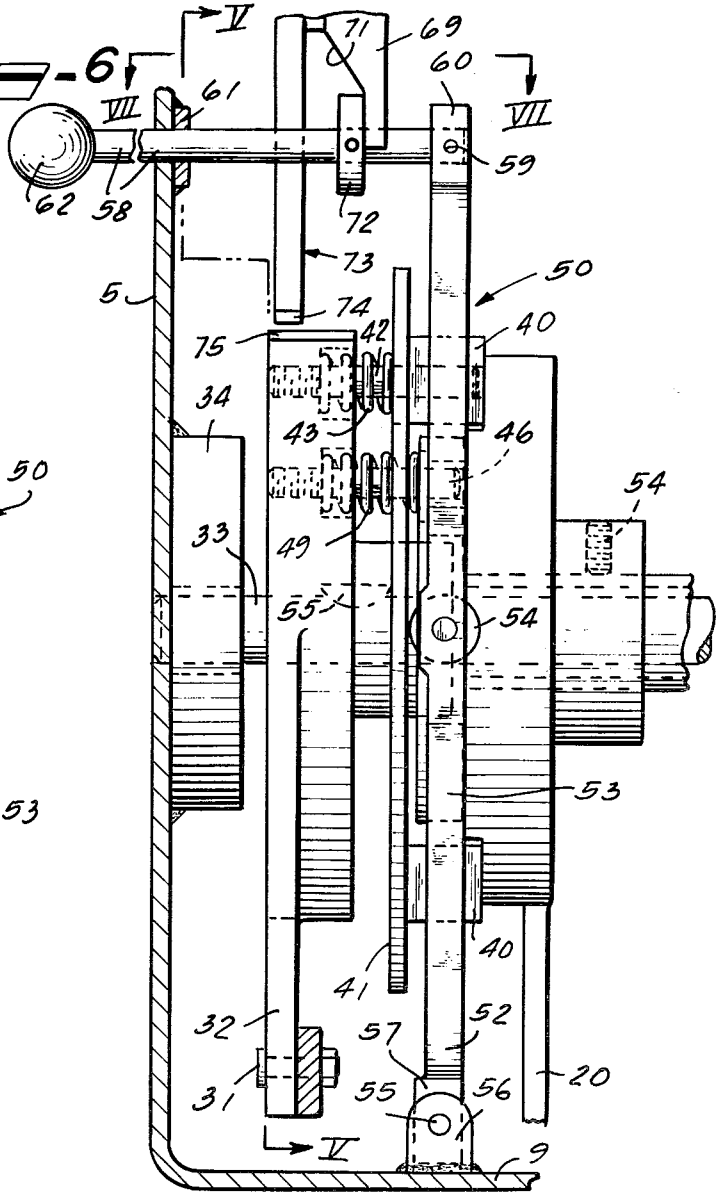
FIG. 6 is a sectional view of the structure of FIG. 5, taken approximately on the line VI—VI of FIG. 2.
Figure 5:
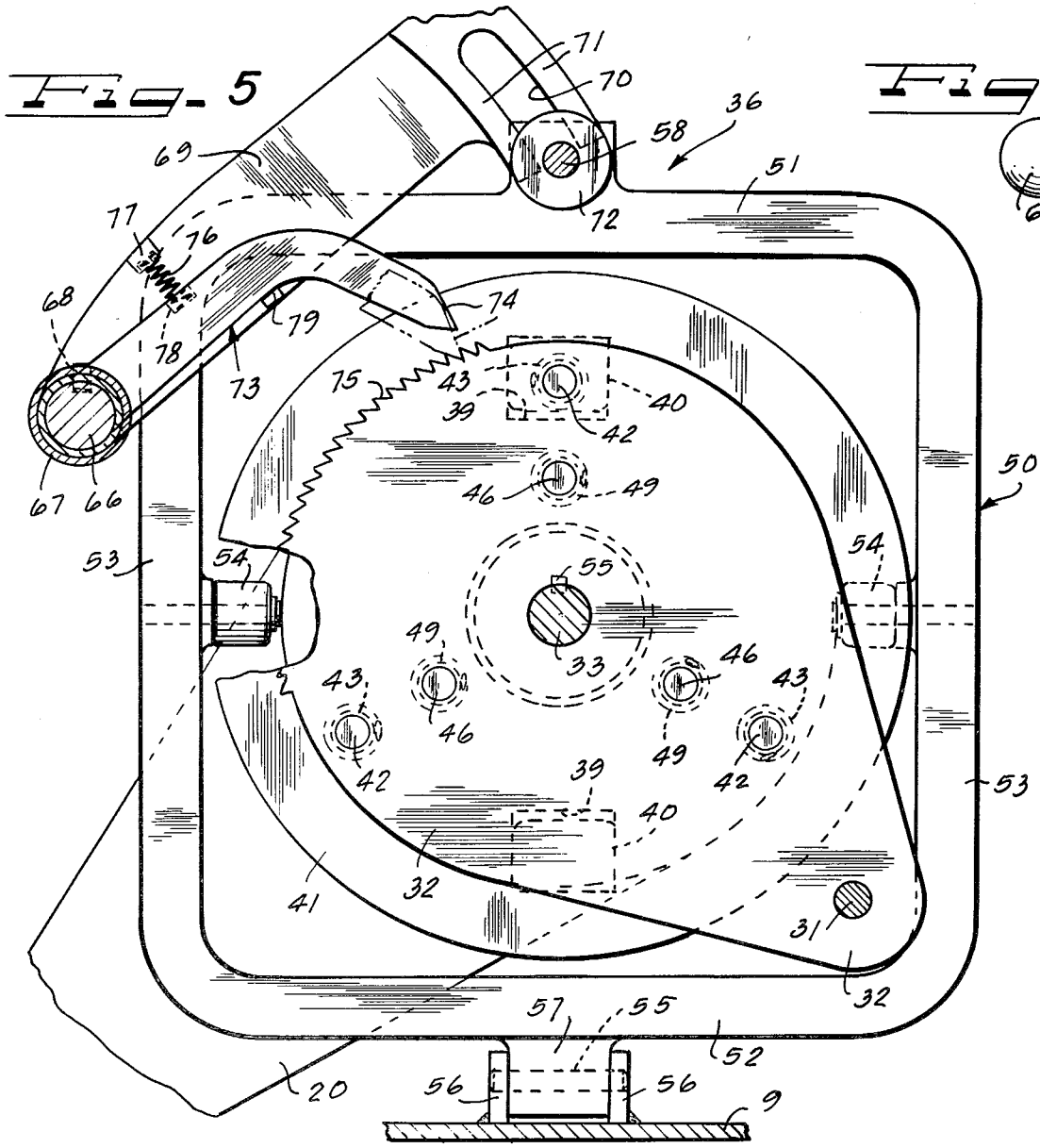
FIG. 5 is a sectional view taken approximately on the line V—V of FIG. 2, illustrating details of the control mechanism for effecting the desired adjustment of the bed.

The structures for controlling the clutch 35, indicated generally in FIG. 1 by the numeral 36, are illustrated in FIGS. 5–7.

The control mechanism, indicated generally by the numeral 36, comprises a yoke member indicated generally by the numeral 50, which in the embodiment illustrated is of generally square configuration having transversely extending top and bottom members 51 and 52, respectively, connected at their opposite sides by vertically extending connecting members 53, each of which supports a freely rotatable roller 54. Such rollers are suitably positioned on the yoke for engagement with the rear face of the clutch plate 41 as will be apparent from a reference to FIGS. 6 and 7. As will also be apparent therefrom, the yoke 50 is pivotally supported from the bottom wall 9 of the base structure 1 on a pivot pin 55 supported from the bottom 9 by spaced parallel trunnions 56, with the pin extending through the downwardly depending lug 57 rigidly connected to the bottom member 52 of the yoke. Thus, by pivoting the yoke 50 about the pin 55 in a counterclockwise direction, as viewed in FIG. 6, the rollers 54 bearing on the adjacent face of the clutch disc 41 will move the latter, in opposition to the springs 43, to the left as viewed in such figure until the lugs 40 are disengaged from the recesses 39 in the adjacent or hub portion of the arm. The linkage associated with the arm 32 is thereby disconnected from the arm 20 and thus from the hollow shaft 14 and the power source 16. Preferably only one pair of notches 39 are provided, so that upon disengagement of the clutch plate 41 from the arm 20, and initial movement of the arm 32 relative to the arm 20, the free end edges of the lugs 40 will bear on the smooth face 37, whereby re-engagement of the lugs 40 and the notches 39 cannot be effected until the arms are returned to their original positions.

It will be appreciated that manual control means for actuating the yoke 50 involves two different operations in order to provide the desired functions under different conditions with respect to the position of the frame member 13. Thus, assuming that the frame member 13 is in an elevated position and it is desired to move the same to a Trendelenburg position, i.e. lowering the head end controlled by the arms 32, it is only necessary to release the clutch plate 41 and thereby release the associated arm 32 to permit the head end of the bed to move downwardly. Upon such release the brake block 45 will, of course, control such downward movement to provide a smooth, even action and eliminate any abrupt dropping of such head end. On the other hand, if it is desired to move the frame member 13 into the Trendelenburg position from an initial lowered position of the frame 13 or to provide a reversed Trendelenburg position from an elevated position of the frame member, it not only is necessary to disconnect the linkage associated with the arm 32 from the power source but to also insure that such arm will be retained either in its lowered position while the foot end is elevated, or be retained in its elevated position while the foot end is lowered. An additional control structure is therefore provided which will perform both desired functions.

To effect merely release of the clutch 41, a pull shaft 58, may be provided, with the shaft illustrated being pivotally connected to the yoke 50 by a pin 59 extending through the shaft 58 and supported in a lug 60 extending upwardly from the top member 51 of the yoke. The shaft 58 is cooperably supported by the sidewall 5 of the base structure, for example in a suitable hub or boss member 61, mounted on the inner face of the wall 5. The end of the shaft 58, extending outwardly from the wall 5, terminates in a manually engageable knob 62 by means of which the shaft 58 may be moved in a withdrawing direction with respect to the wall 5, thus pivoting the yoke 50 about the pin 55, by means of which movement in the disconnection of the arm 32 with respect to the arm 20 may be effected. In operation, the yoke 50 would be actuated by means of the knob 62 merely for a sufficient length of time to permit initial movement of the arm 32 whereby the lugs 40 are moved sufficiently out of alignment with the slots 39 to prevent re-engagement thereof.

As it is also necessary to effect disengagement of the clutch in the second case where the arm 32 is to remain stationary, the control means to accomplish this function may also utilize, in part, the described mechanism for merely disengaging the clutch. For this purpose, a generally L-shaped, manually actuatable lever 63 is provided, the outer leg 64 of which is disposed exteriorly of the wall 5 and terminates at its free end in a manually engageable knob 64. The other transversely extending leg 66 of the arm 63 extends through the sidewall 5 and is rotatably supported in a bushing 67 mounted on the sidewall 5. Rigidly secured to the leg 66 adjacent the inner end thereof by suitable means, such as a key member 68, is a cam arm 69 having a slot 70 therein adjacent its free end, adapted to receive the adjacent portion of the shaft 58, as clearly shown in FIGS. 5 and 6. As illustrated in FIGS. 6 and 7, the arm 69 is provided adjacent the slot 70 with a cam surface 71 which is adapted to engage a collar 72 suitably carried on the shaft 58, whereby the same is fixed with respect to axial movement thereof relative to the shaft 58. Thus, by movement of the lever 63 in a direction to rotate the leg 66 thereof in a clockwise direction the cam surface 71 bearing on the collar 72 will move the yoke 50 in clutch disengaging direction to permit release of the arm 32 from the arm 20, and thus perform the same function as actuation of the shaft 58 by means of the knob 62, as previously described.

However, freely rotatably mounted on the leg 66 is a pawl, indicated generally by the numeral 73, which is illustrated as being of generally L-shaped configuration and having a pointed end 74 which is so disposed that it can be engaged with cooperable ratchet teeth 75 disposed on the adjacent periphery of the arm 32, as clearly illustrated in FIG. 5. The pawl 73 is urged in a direction toward the arm 32 by suitable means such as a compression spring 76, suitably extending between the arm 69 and the pawl 73, for example, one end of the spring being suitably supported by a lug 77 carried by the arm 69 and the opposite end seated in a bore 78 in the pawl 73. The latter is retained in its normal inoperative position, illustrated in FIG. 5, by suitable means such as a lug 79 extending laterally outward from the arm 69 which forms a stop for the pawl, to prevent further movement of the latter toward the arm 32. The proportions of the pawl and the cam surface 71 of the arm 69 are so proportioned that during initial movement of the arm 69, prior to disengagement of the lugs 40 from the arm 20, the end of the pawl 74 will engage teeth 75 on the arm 20, locking the latter in its then present position. Continued movement of the arm 69 will result in the camming action previously referred to and ultimate disengagement of the arm 32 from the arm 20 and the power source 16. The latter may then be actuated to operate the arm 20, either raising or lowering the foot end of the bed.

It will be appreciated that by means of this arrangement, the Trendelenburg position may be readily effected with merely a single movement of the frame member to accomplish such positioning. Thus, if the frame member is in an elevated position, the head end may be directly lowered, or if the frame member is in a lowered position, the foot end may be directly raised without any intermediate movements. Likewise, if the reverse Trendelenburg position is desired the frame member 13, if not in elevated position, is raised thereto, following which the lever 63 is actuated to retain the arm 32 in position and disconnect the latter from the arm 20. The power source 16 then may be actuated to lowe the foot end of the frame member 13. As the reverse Trendelenburg position is not considered an emergency position, the fact that an additional raising operation might be required is of no consequence.

While FIGS. 1–7 illustrate a construction in which the control mechanism is disposed at one side of the bed, the structure also may be so designed that it may be actuated from either side of the bed. FIG. 8 schematically illustrates an arrangement in which the manual handles or controls may be disposed at opposite sides of the bed and actuated from either side.

As illustrated in FIG. 8 the general manual actuating structure is substantially the same as that illustrated in FIG. 5 with the exception that it is reversed, i.e. disposed at the right-hand side of the control structure instead of the left as viewed in FIG. 5, whereby the leg 66 of FIG. 5 may be in the form of a shaft which extends from one side of the bed to the other, suitably journaled in means carried by the side members 5, to which shaft the cam arm 69 and the arm 64 are rigidly secured. The arm 69 and pawl 73 may be of a construction substantially identical to that illustrated in FIG. 5 with the exception that the pointed end configuration of the pawl is reversed to provide proper interlocking action with the teeth 75 of the arm 32. In addition, the pawl 73 is extended beyond the shaft 66 to form an extension 80 which is adapted to bear on a rotatable cam member 81, rigidly connected to and rotatable with a shaft 82 which likewise may extend from one side of the bed to the other, through the adjacent sidewalls 5 and provided at each end with an actuating lever terminating in a manually engageable knob 62.

The cam 81 has a configuration such that when the actuating lever and associated knob 62 are in the position illustrated in FIG. 8, the cam suitably engages the extension 80 of the pawl preventing the latter from engaging the teeth of the arm 32 in the event the cam arm 69 is actuated, whereby the pawl will not interfere with movement of the arm 32 and associated linkage. However, the cam 81 may be suitably rotated, for example, in a clockwise direction by manual engagement with the knob 62 to release the pawl 73, permitting the latter to engage the teeth on the arm 32 in the event the cam arm 69 is actuated, In such position the arm 32 and associated linkage will be retained in position but the arm will be disconnected from the power source. This actuation would be utilized in realizing the reverse Trendelenburg position in which the elevated head end of the frame 13 would be maintained while permitting lowering of the foot end.

As illustrated in FIG. 8, the respective positions may accordingly be designated by respective index lines with the upper one being marked to indicate that it represents the Trendelenburg position while the bottom one indicates the reverse Trendelenburg position. While suitable detent means may be provided for normally retaining the shaft 82 and associated structure in either of its adjusted positions, in the construction illustrated the action of the spring 76 would maintain the extension 80 of the pawl 73 in engagement with the cam when the latter is in the Trendelenburg position and the weight of the arms and actuating knobs 62 would retain the cam in inoperative position, by the action of gravity, in the event the reverse Trendelenburg position is desired.

It will also be appreciated from the above disclosure that the novel U-shaped configuration of the structure, which is achieved without impairing the mechanical operation of the elevating and lower mechanism, enables the patient to be readily serviced with respect to bed pans, etc. in accordance with techniques involving disposition of the structures involved below the mattress structure.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In power operated bed structure having a relatively stationary base structure and a mattress-supporting structure, having a head end and a foot end, adapted to support a mattress in a planar position, in which it may be elevated and lowered relative to the base structure by corresponding movement of said mattress-supporting structure, the combination of connecting linkage between the foot end and the base structure and connecting linkage between the head end and the base structure, for supporting the respective ends in elevated or in lowered positions, power means carried by the base structure operatively connected to one of said linkages, for elevating and lowering the associated end of the mattress-supporting structure, means for selectively connecting the other of said linkages to the power source for simultaneous actuation of such other linkage with the first-mentioned linkage, a mattress, while supported in such a planar position, whereby the mattress-supporting structure may be elevated and lowered relative to the base structure, and means for retaining the end of the mattress-supporting structure associated with said other linkage, in position independently of its connection to the power source, whereby such end of the mattress-supporting structure may be disposed in a lowered position relative to the opposite end thereof to tilt the plane of a mattress supported by said mattress structure.

2. A bed structure according to claim 1, comprising in further combination, manually actuatable control means for actuating said selective connecting means to disconnect said other linkage from said power source.

3. A bed structure according to claim 2, wherein said manually actuatable control means includes manually actuatable elements at each side of the bed, whereby such control means may be actuated from either side of the bed.

4. A bed structure according to claim 2, comprising in further combination, means cooperable with said second mentioned linkage for opposing downward movement of the end of the mattress supporting structure associated therewith, when said end is in an elevated position and the associated linkage is disconnected from said power source, to provide a relatively smooth lowering of such end independently therefrom.

5. A bed structure according to claim 1, comprising in further combination, manually actuatable means cooperable with said retaining means, for controlling said second mentioned linkage and the associated end of the mattress-supporting structure, whereby following disconnection of such linkage from said power source, such linkage and associated end of the mattress-supporting structure will remain substantially at the same elevation prior to such disconnection.

6. A bed structure according to claim 5, wherein said manually actuatable control means includes manually actuatable elements at each side of the bed, whereby such control means may be actuated from either side of the bed.

7. A bed structure according to claim 5, comprising in further combination, further manually actuatable means for actuating said selective connecting means independently of said first mentioned contol means, to disconnect said second mentioned linkage from said power source.

8. A bed structure according to claim 2, wherein said means opposing downward movement of the one end of the mattress-supporting structure comprises a pair of approved friction surfaces in pressure contact.

9. In a power operated bed structure having a relatively stationary base structure and a mattress-supporting structure adapted to be elevated and lowered relative to the base structure and having a head end and a foot end, the combination linkage between the foot end and the base structure and connecting linkage between the head end and the base structure, for supporting the respective ends in elevated or in lowered positions, power means carried by the base structure operatively connected to one of said likages, for elevating and lowering the associated end of the mattress-supporting structure, means for selectively connecting the other of said linkage with the first-mentioned linkage, and means for retaining the end of the mattress-supporting structure, associated with said other linkage, in position independently of the connection of said other linkage to the power source, said selective connecting means comprising a clutch mechanism having a release lever forming manually actuable means cooperable with said retaining means, for controlling said second mentioned linkage and the associated end of the mattress-supporting structure, whereby following disconnection of such linkage from said power source, such linkage and associated end of the mattress-supporting structure will remain substantially at the same elevation existing prior to such disconnection.

10. A bed structure according to claim 9, wherein said retaining means comprises a ratchet member movable with a portion of the associated linkage and a cooperable ratchet pawl.

11. A bed structure according to claim 10, wherein said pawl is arranged for actuation to retaining position by actuation of the manual actuatable for said clutch mechanism.

12. A bed structure according to claim 11, comprising further manually actuatable means for rendering said pawl inoperative whereby said clutch mechanism may be actuated independently of actuation of said pawl.

13. A bed structure according to claim 12, wherein the manually actuatable means for actuating said clutch mechanism, and said means for rendering said pawl inoperative each includes manually actuatable means at each side of the bed, whereby manual control thereof may be effected from either side of the bed.

14. A power operated bed structure comprising a relatively stationary base structure and a mattress-supporting structure adapted to be elevated and lowered relative to the base structure, the latter being of generally U-shaped configuration in plan, having a pair of spaced leg portions extending lengthwise of the bed and a transversely extending intermediate portion connecting the leg portions at one end of the latter, whereby the opposite end of the base structure is open, connecting linkage adjacent said connecting portion extending between the base structure and the adjacent end of the mattress supporting structure, laterally spaced connecting linkages, along each leg portion of said base structure, extending between the latter and the adjacent end of the mattress supporting structure, power means carried by the base structure at the end thereof adjacent said connecting portion and operatively connected to said linkages, for effecting elevation and lowering of said mattress-supporting structure, with the latter overlying the otherwise unrestricted space defined by the leg portions, the intermediate sections and the open end of the base structure which is freely accessible from said open end thereof.

15. A bed structure according to claim 14, wherein said power means is operatively connected to the linkage adjacent such power means, for elevating and lowering the associated end of the mattress-supporting structure, means adjacent said last mentioned linkage for selectively connecting the other linkages to the power source for actuation of such other linkages with said first mentioned linkage, and means for retaining the end of the mattress-supporting structure, associated with said second mentioned linkages, in position independently of the connection of said first mentioned linkage to the power source.

16. A bed structure according to claim 15, comprising in further combination means cooperable with said second mentioned linkages for opposing downward movement of the end of the mattress supporting structure associated therewith, when said end is in an elevated position and the associated linkages are disconnected from said power source, to provide a relatively smooth lowering of such end independently therefrom.

17. A bed structure according to claim 16, comprising in further combination, manually actuatable control means for actuating said selective connecting means to disconnect said other linkage from said power source.

18. A bed structure according to claim 17, wherein said manually actuatable control means includes manually actuatable element at each side of the bed, whereby such control means may be actuated from either side of the bed.

19. A bed structure according to claim 18, comprising in further combination, manually actuatable means for retaining said second mentioned linkages and the associated end of the mattress-supporting structure, following disconnection of such linkages from said power source, at substantially the same elevation existing prior to such disconnection.

20. A bed structure according to claim 19, comprising in further combination, further manually actuatable means for actuating said selective connecting means independently of said first mentioned control means, to disconnect said second mentioned linkages from said power source.

21. In a power operated bed structure having a relatively stationary base structure and a mattress-supporting structure adapted to be elevated and lowered relative to the base structure and having a head end and a foot end, the combination of connecting linkage between the foot end and the base structure and connecting linkage between the head end and the base structure, for supporting the respective ends in elevated or in lowered positions, power means carried by the base structure operatively connected to one of said linkages, for elevating and lowering the associated end of the mattress-supporting structure, means for selectively connecting the other of said linkages to the power source for actuation of such other linkage with the first-mentioned linkage, and means, comprising a ratchet member movable with a portion of the associated linkage and a cooperable ratchet pawl, for retaining the end of the mattress-supporting structure, associated with said other linkage, in position independently of the connection of said other linkage to the power source, and manually actuatable means cooperable with said retaining means for controlling said second mentioned linkage and the associated end of the mattress-supporting structure, whereby following disconnection of such linkage from said power source, such linkage and associated end of the mattress-supporting structure will remain substantially at the same elevation existing prior to such disconnection.

* * * * *